United States Patent [19]

Wilbanks

[11] 4,002,133

[45] Jan. 11, 1977

[54] CATAMARAN

[76] Inventor: John V. Wilbanks, Rte. 1, Box 304, Theodore, Ala. 36582

[22] Filed: Sept. 26, 1975

[21] Appl. No.: 616,908

Related U.S. Application Data

[63] Continuation of Ser. No. 449,275, March 8, 1974, abandoned.

[52] U.S. Cl. ..... 114/61; 114/39

[51] Int. Cl.[2] ..... B63B 1/12

[58] Field of Search ..... 114/61, 66.5 F, 39, 114/56

[56] References Cited

UNITED STATES PATENTS

| | | | |
|---|---|---|---|
| 2,106,432 | 1/1938 | McIntyre | 114/39 |
| 3,077,850 | 2/1963 | Beuby | 114/39 |

*Primary Examiner*—Trygve M. Blix
*Assistant Examiner*—Sherman D. Basinger
*Attorney, Agent, or Firm*—Newton, Hopkins & Ormsby

[57] ABSTRACT

A catamaran is disclosed having a frame supported by a plurality of hulls with each hull having a bow and a stern with maximum hull beam breadth located along a lateral plane intermediate the bow and stern. The distance between the bow and stern of each hull is between approximately 3 and 3½ times the distance between the bow and lateral plane of maximum hull beam width. The distance between the bow and stern of each hull is also between approximately 5½ and 6 times the maximum hull beam width. The surfaces of the hull bilges in lateral planes intermediate the bow and stern define circular arcs of diverse radii.

5 Claims, 6 Drawing Figures

CATAMARAN

This is a continuation of application Ser. No. 449,275, filed Mar. 8, 1974, now abandoned.

BACKGROUND OF THE INVENTION

This invention relates generally to catamarans, and particularly to catamaran hull configurations.

Heretofore, catamaran hulls have taken several diverse shapes and sizes. For example, in U.S. Pat. No. 2,106,432 catamaran hulls are shown which are of generally eliptical configuration with some being circular in the lateral plane of maximum beam breadth. In U.S. Pat. No. 2,944,505 trapezoidal hull configurations are illustrated for use on catamarans. In U.S. Pat. No. 3,656,445 a hull configuration is disclosed consisting of two scalene triangles having a common side lying in a central horizontal plane.

Many of the prior art hulls have proven relatively costly to mold and manufacture due to the complexity of their shapes. This complexity, which exists even though bilateral symmetry be present, has also enhanced drag which, in turn, has limited catamaran speed. That the peripheral surfaces ob both bilge and freeboard portions of the hull have been of non-circular arc configurations throughout much of the length of the hulls has further served to limit the region of laminar flow thereover, particularly during periods of pitch and roll. These prior art hulls have furthermore produced discontinuities in resistance to roll and pitch creating a pronounced roughness in ride. The changes in water displacement patterns occasioned by roll have also enhanced drag due to the constant reshifting of flow pressure patterns adjacent the hull shells. Design attempts at minimizing such have been quite difficult due to variation in catamaran load conditions.

Accordingly, it is a general object of the present invention to provide an improved catamaran.

More specifically, it is an object of the present invention to provide a catamaran hull having enhanced speed characteristics and smoothness of ride.

Another object of the invention is to provide a catamaran hull of relatively simple shape and configuration which is easy to mold and form.

SUMMARY OF THE INVENTION

In one form of the invention a catamaran is provided having a frame supported by a plurality of hulls with each hull having a bow and a stern with maximum hull beam breadth located along a lateral plane intermediate the bow and stern. The distance between the bow and stern of each hull is between approximately 3 and 3 ½ times the distance between the bow and lateral plane of maximum hull beam breadth.

In another form of the invention a catamaran is provided having a frame supported by a plurality of hulls with each hull having a bow and a stern with a lateral plane of maximum hull beam breadth located between the bow and stern. The distance between the bow and stern of each hull is between approximately 5½ and 6 times the maximum hull beam breadth.

In yet another form of the invention a catamaran is orovided having a frame supported by a plurality of hulls with each hull having a bow and stern through which a hull centerline passes. The surface of the hull defines a plurality of circular arcs of diverse radii as measured from the centerline at a plurality of distances between the bow and the stern.

DETAILED DESCRIPTION OF THE DRAWING

Figure 1:
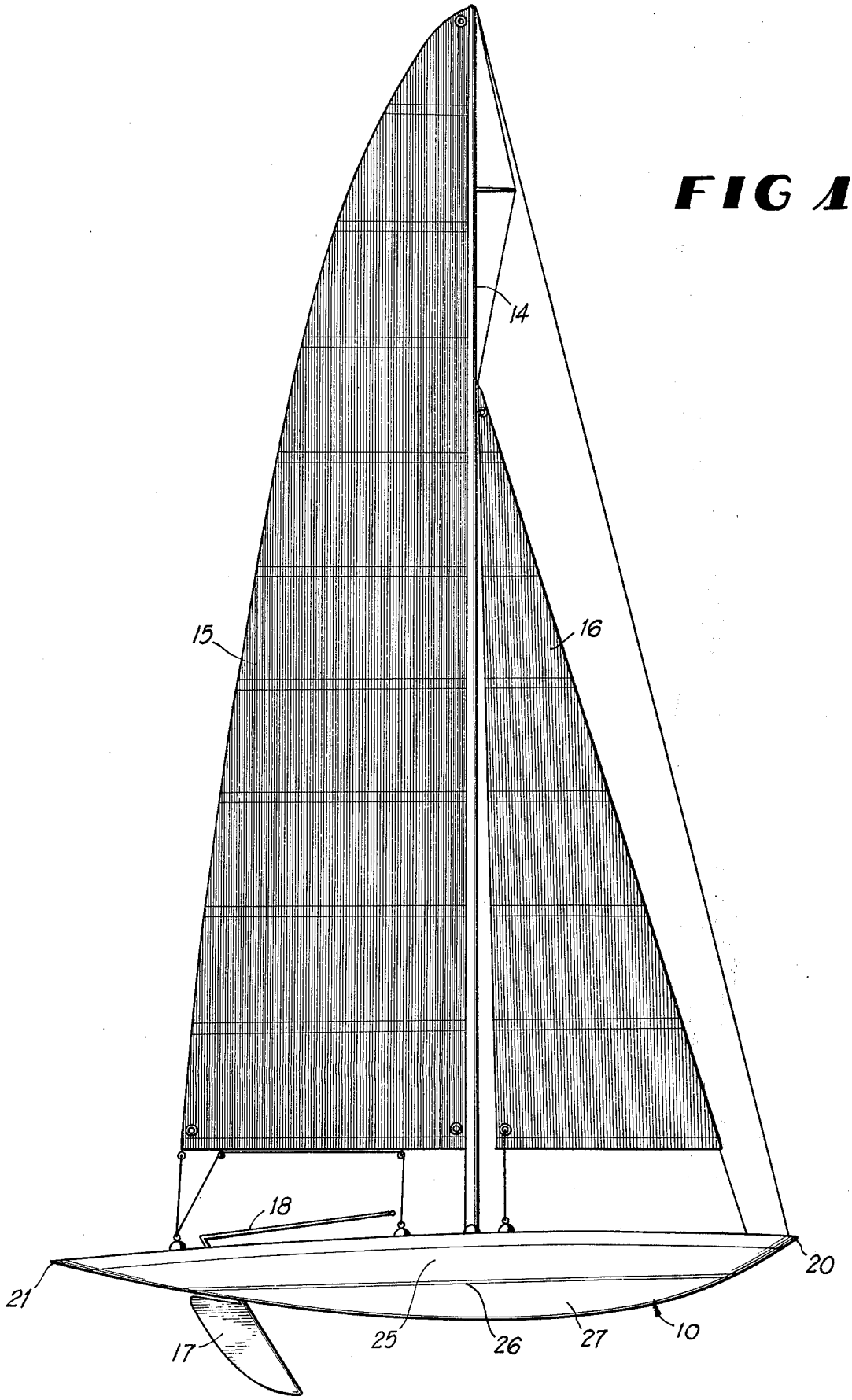
FIg. 1 is a side view in elevation of a catamaran embodying principles of the present invention in one preferred form.

Referring now in more detail to the drawing, there is shown a catamaran embodying principles of the invention in one preferred form and including a pair of mutually spaced, parallel hulls 10 held together by a frame 12 from which upwardly extends a mask 14 supporting a mainsail 15 and jib 16. A rudder 17 and tiller 18 are also supported by the frame amidships.

Figure 2:
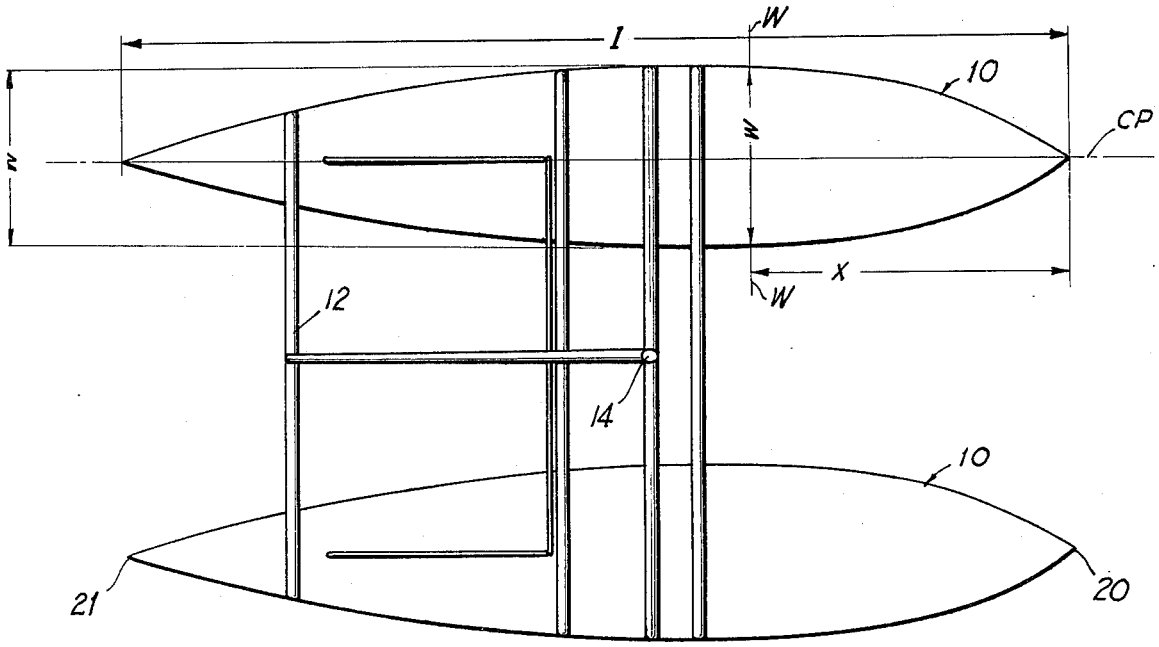
FIG. 2 is a plane of the view of the catamaran hull and frame shown in FIG. 1.
Figure 3:
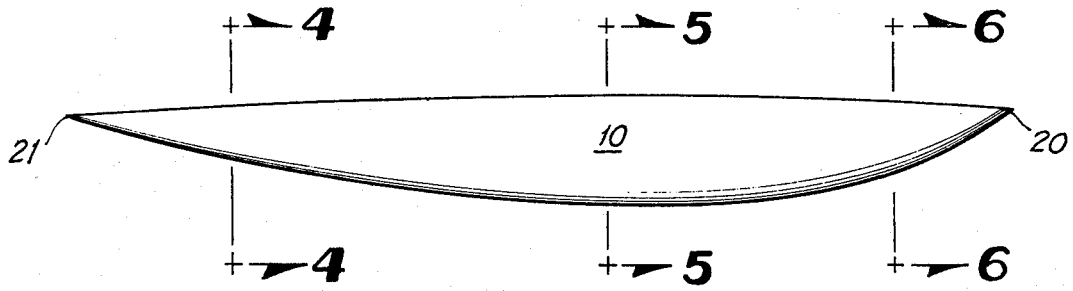
FIG. 3 is a side view in elevation of one hull of the catamaran depicted in FIGS. 1 and 2.
Figure 4:
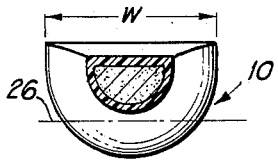
FIGS. 4–6 are end on views in cross-section taken along planes 4—4, 5—5, and 6—6, respectively of the catamaran hull shown in FIG. 3.
Figure 5:
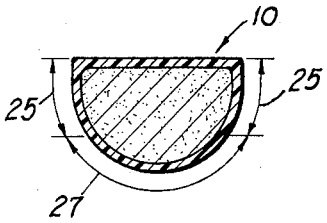
Figure 6:
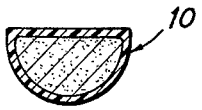

With reference to FIG. 2 each of the hulls is seen to be double-ended having a bow 20 and a stern 21 disposed along a hull centerplane CP with the sides of the hull having bilateral symmetry of shape and size. The sides of the hull coverge inwardly to intersect at the bow and stern from a plane W along which the maximum beam breadth $w$ of the hull lies. It will also be noted that plane W lies a distance $x$ from bow 20 as measured along centerplane CP. According to principles of the invention width $w$ is between 5½ and 6 times the overall length $l$ of the hull between bow and stern. In accordance with other principles of the invention plane W should be at a distance $x$ from bow 20 of between 3 and 3½ times the overall length $l$ of the hull.

With reference next to FIGS. 3–6 it may be seen that the periphery of the surface of the hull lying along planes 4—4, 5—5, and 6—6 is semi-circular both as to freeboard 25 located above normal load water-line 26 and bilge 27 located thereunder. This is to say that the peripheral surface of the hull in transverse cross-section along these planes defines arcs of circles measuring approximately $\pi r$ in length where $r$ is the radius of the circle at each measured point longitudinally along the hull within each plane. In actuality, the surface of this hull is semi-circular in transverse cross-section vertically its entire length.

We thus see that though the width of the hull is continuously changing from minimal at bow and stern to maximal at plane W, at any one point along the length of the hull and shell lying within a lateral plane transversing the centerline C/L defines an arc of a circle. This configuration greatly enhances the speed and smoothness of ride characteristics of the catamaran as well as simplifying construction.

Hulls having circular cross-section shell configurations are highly unsuited for most ship configurations due to the fact that they have minimal righting moment during roll in so much as center of bouyancy and center of gravity remain in a vertical plane during such roll. This, of course, minimizes the tendency for righting due to the absence of a righting moment. In catamarans however, which, by definition, possess a plurality of hulls, such adverse characteristics are of little importance due to the high stability provided by the plurality of laterally spaced hulls. Accordingly, I have found that hulls having such semi-circular shells may be successfully employed in catamarans. Speed is enhanced through such design as is the magnitude laminar motion of water thereover. Minimal bounce is encountered during roll and pitch due to the minimal changes in water displacement patterns occurring during such movements.

For the purpose of this patent application hull dimensions are intended to apply to that portion of the hull which may ordinarily be expected to be in contact with the supporting body of water. In other words, the top surface of the hull may take any number of configurations without altering or otherwise producing a significant change in performance whereas the hull bilge and portion of the freeboard adjacent thereto is preferably of circular arc shape. In addition, the distance relations described are intended to be minimal which is to say that $l$ and $x$ are measured along centerplane C/P except in the case of $w$ which is measured along the horizontal plane of maximum hull width lying within plane W. Though the exemplary hull has each of these features such is not necessary since inclusion of any one has been found to enhance catamaran performance characteristics. Many other modifications and additions may, of course, be made thereto without departure from the spirit and scope of the invention as set forth in the following claims.

What is claimed is:

1. In a catamaran having a frame supported by a plurality of double-ended complementary hulls having straight parallel keels with each hull symmetrical with respect to itself and having a bow and a stern at which the sides of the hull converge and through which a hull centerline passes, the improvement comprising each hull being arcuate in side elevation along its keel throughout substantially its length from bow to stern and having the surface of the hull bilge rigid and defining a plurality of concentric circular arcs of increasing and then decreasing radii as measured abeam the centerline throughout substantially its length from the bow and stern, said arcuate keel extending forwardly and rearwardly beyond and above the normal water line of said hull, and said hull below the water line having essentially smooth and unobstructed surfaces as to permit the unobstructed flow of water along the hull bow portion to stern portion.

2. The catamaran defined in claim 1 wherein the distance between the bow and stern of each hull is between approximately 3 and 3½ times the distance between the bow and lateral plane of maximum hull breadth of each hull.

3. The catamaran defined in claim 1 wherein the distance between the bow and stern of each hull is between approximately 5½ and 6 times the maximum hull beam breadth.

4. The catamaran defined in claim 1 wherein the distance between the bow and stern of each hull is between approximately 3 and 3½ times the distance between the bow and lateral plane of maximum hull beam breadth, and the distance between the bow and stern of each hull is between approximately 5½ and 6 times the maximum hull beam breadth.

5. The catamaran defined in claim 1 including rudders respectively projecting from beneath the keels of each of said hulls, said rudders being wholly below said water line inwardly of the bows and sterns of said hulls.

* * * * *